United States Patent [19]

Reghi

[11] 4,338,140

[45] Jul. 6, 1982

[54] COATING COMPOSITION AND METHOD

[75] Inventor: Gary A. Reghi, Sterling Hts., Mich.

[73] Assignee: Hooker Chemicals & Plastics Corp., Warren, Mich.

[21] Appl. No.: 168,811

[22] Filed: Jul. 14, 1980

Related U.S. Application Data

[63] Continuation-in-part of Ser. No. 879,648, Feb. 21, 1978, abandoned.

[51] Int. Cl.[3] ..... C23F 7/00; C23F 7/08

[52] U.S. Cl. ..... 148/6.14 R; 148/6.15 R

[58] Field of Search ..... 148/6.14 R, 6.15 R; 106/14.14; 423/69, 72; 252/79.3

[56] References Cited

U.S. PATENT DOCUMENTS

| | | | |
|---|---|---|---|
| 1,710,743 | 4/1929 | Pacz | 148/6.27 |
| 3,160,506 | 12/1964 | O'Connor et al. | 148/6.2 |
| 3,682,713 | 8/1972 | Ries et al. | 148/6.27 |
| 3,912,548 | 10/1975 | Faigen | 148/6.27 |
| 3,964,936 | 6/1976 | Das | 148/6.27 |
| 4,017,334 | 4/1977 | Matsushima et al. | 148/6.27 |
| 4,148,670 | 4/1979 | Kelly | 148/6.15 R |

FOREIGN PATENT DOCUMENTS

| | | | |
|---|---|---|---|
| 2446492 | 4/1975 | Fed. Rep. of Germany | 148/6.15 R |
| 2704260 | 8/1978 | Fed. Rep. of Germany | 148/6.27 |

OTHER PUBLICATIONS

Hopkins, Chapters in the Chemistry of Less Familiar Elements, vol. II, Stipes Pub. (1939), pp. 5–7.

Imperial Metal Industries, Chem. Abs. 71:33000u (1969).

*Primary Examiner*—Ralph S. Kendall

*Attorney, Agent, or Firm*—Richard P. Mueller; Arthur E. Kluegel

[57] ABSTRACT

An aqueous acidic composition provides improved corrosion resistance to a metal, e.g., ferrous, zinc or aluminum surface upon contact. The composition contains dissolved hafnium and/or zirconium, fluoride, preferably a vegetable tannin compound, and optionally phosphate ions.

81 Claims, No Drawings

COATING COMPOSITION AND METHOD

REFERENCE TO RELATED APPLICATIONS

This application is a continuation-in-part of prior copending U.S. application Ser. No. 879,648, filed Feb. 21, 1978 for "Corrosion Inhibiting Hafnium Compositions" now abandoned.

BACKGROUND OF THE INVENTION

The present invention broadly relates to the art of treating metal surfaces for example, ferrous, zinc or aluminum, to improve the properties thereof and more particularly, to an improved composition and method for treating metal surfaces to produce an adherent corrosion resistant coating thereon which is receptive to organic or siccative coatings.

Environmental regulations directed to a curtailment in the level of discharge of environmentally objectionable compounds to waste systems has occasioned a substitution of conventional chromium and phosphate containing treating chemicals in the metal treatment industry with alternative compounds devoid of chromium compounds. For example, U.S. Pat. No. 4,017,334 discloses an aqueous treating composition for aluminum coating containing phosphate, fluoride, titanium and tannin as active coating constituents. U.S. Pat. No. 4,054,466 discloses an aqueous tannin containing composition for metal treatment. U.S. Pat. Nos. 3,682,713 and 3,964,936 disclose aluminum treating compositions containing zirconium and fluoride.

In the treatment of aluminum surfaces, and particularly the surfaces of drawn and ironed aluminum beverage containers, it is important to provide the surfaces of the container with a protective corrosion resistant coating which is substantially colorless in nature and does not impair the taste characteristics of the food or beverages coming in contact with the coating. It is also important that the coating be adherent and receptive to subsequently applied finishes such as paint, varnish, lacquer, etc. to the coated surface. In normal practice, after treatment of the aluminum container, the exterior of the can is decorated and overvarnished on the sidewalls thereof but the exterior bottom of the container receives no organic finish. Accordingly, the only protection afforded to the exterior bottom of the container is the chemical coating.

The qualities required of a coating are many and vary in importance depending on the end use to which the coated article is put. Of concern are:

1. Adhesion of the coating to the metal surface.
2. Adhesion of subsequently applied finish (paint, varnish, lacquer, etc.) to the coated surface.
3. Corrosion resistance of the coated but unfinished surface.
4. Corrosion resistance of the finished surface.
5. Color or colorless nature of the coating.
6. Taste characteristics imparted to food or beverages in contact with the coating or finish.
7. Brightness of the coating.
8. Uniformity of the coating.
9. Coating thickness required to obtain minimum acceptable qualities.
10. Formability of the coated metal article.
11. Etching or other distortion of the metal surface appearance.

In addition to coating quality, the stability of the concentrate and diluted treating bath compositions, the simplicity of process control requirements and energy considerations are of concern to the process operator.

It is also conventional practice after the containers are filled with a beverage such as beer, for example, and sealed, to pasteurize the sealed containers in order to destroy bacteria. This pasteurization process conventionally comprises immersing the filled and sealed cans in water heated at about 150° to about 160° F. for a period of about 30 minutes. The pasteurization treatment does not effect the overvarnished sidewalls of the container but the unvarnished exterior bottom of the container has in many instances undergone severe distortion during pasteurization which is highly objectionable.

It is also conventional for quality control to subject spot samples of the chemically treated containers to a high temperature test to make certain than an adequate chemical coating has been formed thereon. This test usually comprises placing a treated container in a muffle furnace at 1000° F., for a period of 5 minutes. Evidence of a satisfactory coating is visually ascertained by the formation of a dark gold color. Coatings of the type heretofore known have in many instances failed to produce a satisfactory visual color change during the muffle furnace test to enable accurate quality control determination.

It is also desirable in the chemical treatment of such containers that the chemical coating produced is substantially colorless to avoid detracting from the subsequently applied decorative coatings and varnish. Many of the coating systems in accordance with prior art practice result in coatings of a light yellow color which is objectionable, particularly, when the treatment of the containers in the coating solution is prolonged due to line stoppages or the like.

The aqueous acidic coating composition and method of the present invention overcomes many of the problems associated with prior art compositions and practices achieving a substantially colorless, adherent corrosion protective coating on aluminum surfaces which is receptive to subsequently applied organic finishes and which composition and method is effective for forming a coating of the requisite thickness in comparatively short time periods thereby achieving increased throughput and efficiency in metal processing.

SUMMARY OF THE INVENTION

The benefits and advantages of the present invention are achieved in accordance with the composition aspects of the present invention by forming an aqueous acidic treating composition containing as its essential constituents, dissolved metal ions selected from the group consisting of hafnium, zirconium and mixtures thereof, fluoride ions and, preferably, a bath soluble vegetable tannin compound present in amounts effective to produce a corrosion resistant adherent coating on aluminum surfaces. The hafnium and/or zirconium ions are present in an amount of at least about 1 part per million (ppm) to amounts as high as 5000 ppm or greater; the fluoride ions are present in an amount ranging from at least about 1 ppm up to about 6000 ppm or greater; and the vegetable tannin constituent is present in an amount ranging from about 1 ppm, preferably at least about 25 ppm, up to a level corresponding to the solubility of the tannin compound in the aqueous acidic solution.

The treating solutions of the present invention must be adjusted in pH value to yield a pH on the acid side. Best results are obtained at pH values of less than 5 and a pH value is preferably at least 2. When the metal ion in the aqueous acidic bath comprises hafnium or predominantly hafnium, a pH value of less than 3.5 is preferred. When the metal ion in the bath comprises zirconium or predominantly zirconium, a pH of about 3 to about 4.5 is preferred.

In accordance with a preferred embodiment of the present invention, phosphate ions such as introduced by monoammonium phosphate are incorporated in the aqueous acidic treating solution which effectively inhibits discoloration or yellowing of the chemical coating in spite of prolonged treatment times of the aluminum surface at high bath temperatures. It is also contemplated that additional metal ions such as titanium, lithium, or mixtures thereof, can be employed in the bath. The presence of such optional metal ions, however, is not necessary to achieve the benefits of the present invention.

In accordance with the process aspects of the present invention, aluminum surfaces are coated employing the hereinabove described aqueous acidic coating composition by contacting cleaned surfaces with the solution at a temperature of about room temperature (70° F.) up to the boiling point of the solution, preferably temperatures ranging from about 100° F. to about 160° F. for periods of time ranging from about 0.1 seconds up to about 10 minutes with time periods ranging from about 2 seconds to about 1 minute being more typical. The formation of the coating is a function of concentration of the solution, temperature and contact time such that as the temperature and/or concentration of the solution is increased, the contact time can be correspondingly reduced to achieve the requisite coating.

Additional benefits and advantages of the present invention will become apparent upon a reading of the description of the preferred embodiments taken in conjunction with the specific examples provided.

DESCRIPTION OF THE PREFERRED EMBODIMENTS

In accordance with the composition aspects of the present invention, the aqueous acidic coating composition contains as its essential constituents, controlled effective amounts of metal ions selected from the group consisting of hafnium, zirconium and mixtures thereof, fluoride ions and a bath soluble vegetable tannin compound. The zirconium ions can be introduced into the bath by any zirconium compound which is soluble in the aqueous acidic medium and which does not contribute deleterious components to the coating solution. For example, suitable bath soluble zirconium compounds which can be employed include fluozirconic acid, ammonium and alkali metal fluozirconates, zirconium fluoride, zirconium nitrate, zirconium sulfate, or the like. The use of an alkali metal fluozirconate, such as, for example, potassium fluozirconate ($K_2ZrF_6$) as usually preferred in that it simultaneously introduces zirconium and fluoride ions into the bath composition. The concentration of the zirconium ion can broadly range from as low as about 1 ppm to 5000 ppm and even higher with amounts ranging from about 4 ppm to about 100 ppm being preferred. A particularly satisfactory concentration of zirconium is about 50 ppm.

The source of hafnium employed in the present invention may be any hafnium compound which is soluble in the aqueous acidic medium and which does not contribute deleterious components to the coating bath. Examples of available hafnium compounds are set forth in the *Handbook of Chemistry and Physics,* 55th Edition, CRC Press, Inc., Cleveland, Ohio (1974). Preferred sources of hafnium are hafnium oxide and acids or salts based upon hafnium or hafnyl nitrate, fluoride or chloride. The hafnium compound should be included to provide a hafnium content of at least one part per million. Preferably, the hafnium compound is present so as to supply hafnium in a concentration of between 4 and 100 parts per million.

The treating solution may contain only hafnium ions, or only zirconium ions as well as mixtures of the two. When mixtures of the metal ions are employed, the total concentration of the mixture should be within the ranges as previously set forth. In accordance with a preferred embodiment of the present invention, the treating solution contains zirconium ions or predominantly zirconium ions.

The fluoride ion can be introduced into the composition in the form of a simple or complex fluoride compound such as hydrofluoric acid or a simple or bifluoride salt of an alkali metal or ammonium or as a complex fluoride acid or salt based upon an element such as boron, silicon, titanium, zirconium, and the like. The fluoride concentration can range from as low as about 1 ppm up to 6000 ppm or higher with amounts ranging from about 4 to about 100 ppm being preferred. A particularly satisfactory fluoride concentration is about 60 ppm. The particular fluoride ion concentration is preferably controlled in relationship to the quantity of hafnium and/or zirconium ions present. Preferably, when the metal ion is zirconium, the fluoride ion is present at a weight ratio of fluoride to zirconium of at least about 1.25:1. When the metal ion is hafnium, the fluoride ion is preferably present in a weight ratio of F:Hf of at least 0.64:1. The maximum fluoride ion concentration is controlled at a level below that at which an objectionable etching of the aluminum surface occurs. This maximum fluoride concentration is a function of the nature of the aluminum surface being treated, the temperature of the bath and the duration of the treatment time.

In addition to the hafnium and/or zirconium ions and fluoride ions, the bath contains in the preferred embodiment of the present invention, a bath soluble vegetable tannin compound. The chemistry of tanning agents is not completely understood at the present time. They include a large group of water soluble, complex organic compounds widely distributed throughout the vegetable kingdom. All have the common property of precipitating gelatin from solutions and of combining with collagen and other protein matter in hides to form leather. All tannin extracts examined contain mixtures of polyphenolic substances and normally have associated with them certain sugars. (It is not known whether these sugars are an integral part of the structure). For a discussion of tannins, see *Encyclopedia of Chemical Technology,* 2nd Edition, Kirk-Othmer; XII (1976) pp. 303–341 and *The Chemistry and Technology of Leather,* Reinhold Publishing Corporation, New York, pp. 98–220 (1958).

Tannins are generally characterized as polyphenolic substances having molecular weights of from about 400 to about 3000. They may be classified as "hydrolyzable" or "condensed" depending upon whether the product of hydrolysis in boiling mineral acid is soluble or insoluble, respectively. Often extracts are mixed and contain both hydrolyzable and condensed forms. No two tannin extracts are exactly alike. Principal sources of tannin extracts include bark such as wattle, mangrove, oak, eucalyptus, hemlock, pine, larch, and willow; woods such as quebracho, chestnut, oak and urunday, cutch and turkish; fruits such as myrobalans, valonia, divi-divi, tera, and algarrobilla; leaves such as sumac and gambier; and roots such as canaigre and palmetto.

The term "vegetable tannins" is employed to distinguish organic tannins such as those listed in the previous paragraph from the mineral tanning materials such as those containing chromium, zirconium and the like. Hydrolyzable, condensed, and mixed varieties of vegetable tannins may all be suitably used in the present invention.

When a vegetable tannin is employed, it is preferably present in an amount of at least 1 ppm, and more preferably, in an amount of at least 25 ppm up to the solubility of the compound in the bath with upper concentrations of about 500 ppm being satisfactory. Concentrations of about 70 ppm of the tannin compound are particularly satisfactory.

The treating solution of the present invention must be adjusted in pH value to yield a pH on the acid side. Best results are obtained at pH values of less than 5 and the pH value is preferably at least 2. When the metal ion is hafnium or predominantly hafnium, the pH is preferably at least 2 and less than 3.5. When the metal ion in the treating solution is zirconium or predominantly zirconium, the pH is preferably at least 3 up to about 4.5. Depending on the raw material compounds employed to supply the hafnium and/or zirconium and fluoride components, the pH value may be within an acceptacle range without any further adjustment being necessary. On the other hand, if an adjustment of pH is necessary, any of the inorganic or organic compounds commonly used for pH adjustment may be employed. Among these materials are the mineral acids including hydrofluoric, sulfuric nitric and phosphoric acids, as well as the alkali metal and ammonium hydroxides, carbonates and bicarbonates, oxides and silicates.

Other adjuvants may be included in the composition to modify one or more of the qualities of the coating obtained with the bath of the present invention. Among these possible adjuvants are nitrate compounds, phosphate compounds, citrate compounds and compounds containing titanium, lithium, or resinous materials. When employed, the adjuvants will normally be present in minor amounts.

Of the foregoing adjuvants, the bath can optionally but preferably contain phosphate ions in an amount of about 10 up to about 200 ppm, preferably from about 25 to about 75 ppm with amounts of about 45 to about 55 ppm being particularly satisfactory. The inclusion of phosphate ions in the bath has been found to inhibit discoloration or yellowing of the chemical coating formed as a result of prolonged treatment times and also improves depth and intensity of the gold color developed on processed aluminum cans during the muffle furnace test. The inclusion of phosphate ions in the bath, however, has been found to cause discoloration of the unvarnished exterior bottom of a treated aluminum container during the pasteurization step and it is necessary in such instances in which discoloration is undesirable, to incorporate free fluoride ions in the bath to prevent such discoloration. Concentrations of phosphate ions below about 10 ppm are usually undesirable due to decreased inhibition of discoloration during excessive treatment times such as occasioned during line stoppages and also a reduction in the color change during the muffle furnace test. On the other hand, concentrations of phosphate ions in excess of about 200 ppm is undesirable due to the passivating effect thereof and a reduction in the coating action. Additionally, such higher phosphate ion concentrations require an increase in the free fluoride content to avoid discoloration of the treated surface during the pasteurization treatment. Phosphate ion concentrations within the preferred range of about 25 to about 75 ppm provide the desired results in addition to ease of control of a bath during commercial operation.

As previously indicated, the fluoride concentration in the bath is controlled in relationship to the concentration of the hafnium and/or zirconium ions present so as to provide a stoichiometric ratio of at least 6 mols fluoride for each mol of the metal ion present. The inclusion of additional fluoride in the bath to prevent discoloration during pasteurization is controlled to provide a free fluoride content as a function of the phosphate ion concentration. The free fluoride concentration in the bath is conveniently measured by a specific fluoride ion electrode in terms of millivolts (mv) which will vary depending upon the specific composition and concentration of the bath constituents and on the pH thereof. For any particular bath at a substantially constant pH, a correlation can readily be made of the millivolt reading and the free fluoride content which provides satisfactory bath operation and prevents discoloration during the pasteurization treatment. Such millivolt reading serves as a simple commercial control of the bath. For example, a satisfactory bath containing phosphate ions at a pH of about 3.7 is achieved by providing a free fluoride concentration to provide a millivolt reading of about −30 mv calibrated against a standard solution measured at 0 mv containing 4907 ppm $H_2SO_4$(100%), 40 ppm $F^-$ added as NaF and 558 ppm $F^-$ added as $NH_4HF_2$. The appropriate millivolt reading of the free fluoride concentration can readily be ascertained for any bath by simple experimentation to achieve the desired results.

It is also desirable to employ fluoboric acid in the bath in such instances to provide a reservoir source of free fluoride to supplement the free-fluoride concentration as it is consumed in the complexing of aluminum ions formed during the coating reaction.

A particularly satisfactory bath composition according to the present invention contains hafnium and/or zirconium ions in a concentration of about 50 ppm, a total fluoride ion concentration of about 180 ppm, a tannin concentration calculated on a weight equivalent basis to tannic acid of about 70 ppm and a phosphate ion concentration of about 50 ppm.

The composition of the present invention may be employed to treat a surface consisting predominantly of aluminum, zinc, or iron. Any conventional method of contacting the treating solution with the metal surface, e.g., spray, roll coating, immersion, or flooding, may be employed.

The time of contact and the temperature at which the treating solution is maintained are interdependent variables. Employing higher temperatures will normally shorten the contact time required. Furthermore, the time of contact is somewhat dependent upon the method of application employed. Typically, the duration of contact should be from 0.1 seconds to 10 minutes and is preferably between 2 seconds and 1 minute. In the treatment of aluminum beverage containers, for example, production facilities and requirements normally dictate contact times ranging from about 10 seconds to about 30 seconds with 20 seconds being usual. In the treatment of aluminum articles such as extrusions, for example, longer treatment times are feasible providing for a corresponding reduction in the concentration and/or temperature of the treating solution.

The treating solution as applied to the surface to be treated may range from as low as room temperature (70° F., 21° C.) up to the boiling point of the solution with temperatures ranging from about 100° F. to about 160° F. (37° to 71° C.) being preferred. In the treatment of aluminum containers, temperatures ranging from about 100 to about 120° F. are typical.

Bare Corrosion Test

In order to evaluate the resistance to discoloration of a treated but unpainted aluminum surface, a so-called "Bare Corrosion Test" is employed to simulate exposure of the unpainted exterior bottom of an aluminum container during a commercial pasteurization process. For this purpose, an aqueous solution is prepared simulating a typical water composition employed in the pasteurization process containing 82.4 ppm sodium chloride, 220 ppm sodium bicarbonate, 2180 ppm of a water conditioner and the balance deionized water to form one liter. The water conditioning agent employed is a proprietory product supplied by DuBois Chemicals, Inc. under the brand designation DuBois 915 which exhibits a total alkalinity of 5.8% $Na_2O$ and on analysis contains sodium nitrate, carbonate, triethanolamine and a dodicylphenyl polyethylene glycol. The test procedure employing the aforementioned test solution designated as TR-4 test solution involves subjecting the treated unpainted containers to the solution for a specified time e.g. 30 minutes while maintained at a specified elevated temperature e.g. 150° F.±5° F. Following the test, the article is removed, rinsed with water, dried and visually inspected for discoloration. Test articles are rated from 1 (no staining or discoloration) to 10 (dark gold to grey-black discoloration or extensive non-uniform mottling of the surface). Ratings of 1 through 4 are generally considered commercially acceptable in the aluminum can industry whereas ratings of 5 through 10 are not acceptable.

Detergent Immersion Paint Adhesion Test

This test is a measure of the adhesion between an organic finish and a coated substrate. The finished surface is immersed in a standard 1% detergent solution at boiling for either 15 or 30 minutes, rinsed in tap water, cross-hatched (approximately 64 squares/sq. inch), and dried. Scotch-brand transparent tape (#610) is then applied to the cross-hatched area, pulled off, and the amount of paint removed by the tape is observed. Results are rated "Excellent" (100% adhesion), "Good" (95+% adhesion) or "Poor" (less than 95% adhesion).

Water Immersion Paint Adhesion Test

This test is conducted as in the previous paragraph except the painted surface is immersed in tap water for 10 minutes at 180° F. instead of the detergent solution.

In order to illustrate the improved composition and method of the present invention, the following specific examples are provided. It will be understood that the examples are provided for illustrative purposes and are not intended to be limiting of the scope of the present invention as herein described and as set forth in the subjoined claims. The treatment as described in the following examples employing the coating solutions involves a precleaning of an aluminum beverage container employing a sulfuric acid cleaning solution containing a wetting agent therein followed by a warm water rinse. The cleaned can thereafter is subjected to the treating solution at a temperature of 120° F. for a period of 20 seconds. Following the coating treatment, the treated cans are cold water rinsed for 15 seconds followed by a 5 second deionized water rinse and are thereafter dried for 5 minutes in an air circulating oven at 380° F.

EXAMPLE 1

A bath was prepared to contain:

| Component | Concentration, ppm |
|---|---|
| $H_2TiF_6$ | 168 |
| $NH_4H_2PO_4$ | 143 |
| $H_2C_6H_6O_7$ | 46 |
| Tannic Acid[1] | 30 |
| $NH_4HCO_3$ | 411 |
| $HNO_3$ | 588 |
| pH | 2.5 |

[1]Supplied by the Harshaw Chemical Co.

To separate samples of the above bath, hafnyl nitrate was added in various concentrations. Clean aluminum cans were then processed in accordance with previously described treatment sequence.

Can exterior side walls were separated from the can bottom and then painted with a water based white base coat supplied by Inmont Corporation using a #10 draw down bar and oven cured 3 minutes at 400° F. followed by 6 minutes at 360° F.

Results of the bare corrosion test and paint adhesion test are set forth in Table I.

TABLE I

| Hafnium Concentration ppm | Bare Corrosion Test 2 Hours at 165° F. Rating | Water Immersion Paint Adhesion Test % Peel |
|---|---|---|
| 0 | 10 | 0 |
| 4 | 4 | 0 |
| 8 | 2 | 0 |
| 12 | 2 | 0 |
| 16 | 2 | 0 |
| 24 | 2 | 0 |
| 32 | 2 | 0 |

This example demonstrates the marked improvement in bare corrosion resistance imparted by slight concentrations of hafnium. No deleterious effect on paint adhesion was observed.

EXAMPLE 2

A solution was prepared to contain:

| Component | Concentration, ppm |
|---|---|
| $HfO_2$ | 15 |
| HF | 17 |
| Tannic Acid | 169 |
| $HNO_3$ | 299 |
| pH | 2.5 |

An aluminum can was then processed as in Example 1 to form a hafnium-containing coating on the surface and painted as in Example 1. The bare corrosion test for 2 hours at 165° F. produced no staining (a "1" rating). The Detergent Immersion Paint Adhesion Test (15 minutes) resulted in no peeling.

When clean zinc galvanized and cold rolled steel panels were sprayed with the same solution with the same procedure a light gold adherent coating was obtained which exhibited superior qualities compared to cleaned only panels.

EXAMPLE 3

A treating composition was prepared to contain:

| Component | Concentration - ppm |
|---|---|
| $K_2TiF_6$ | 208 |
| $NH_4H_2PO_4$ | 61 |
| Hafnium as hafnyl nitrate | 43 |
| $NH_4HCO_3$ | 434 |
| $HNO_3$ | 500 |
| pH, | 2.9 |

An aluminum can was processed as in Example 1 to form a hafnium-containing coating on the surface. The exterior walls were finished using Coke Red Ink (Acme Ink) using rubber rolls. Over varnish (Clement Coverall P-550-G) was then applied using a #5 draw down bar. The coating was then oven cured for 5 minutes at 385° F., followed by 3 minutes at 410° F. The interior walls were finished with a sanitary lacquer (Mobil S-6839-009) using a #20 draw down bar with oven cure for 3 minutes at 410° F. The Bare Corrosion Test for 30 minutes at 155° F. produced no staining of the unfinished can bottom (a "1" rating). When hafnium was omitted, a gold discoloration of the aluminum surface occured under the same test conditions (a "7" rating). The Detergent Immersion Paint Adhesion test (30 minutes) gave Excellent adhesions.

EXAMPLE 4

A standard or control solution designated as Test Solution 1 is prepared by adding 0.28 gm $K_2ZrF_6$, 3.4 ml 70% nitric acid and 26 ml of a 10% ammonium bicarbonate solution to water to yield 6 liters of Test Solution 1. Similar solutions are prepared in 6 liter quantities to which 0.25 gm; 0.5 gm and 0.75 gm per 6 liters of tannic acid is added to yield Test Solutions 2–4, respectively. Test Solutions 1 through 4 contain an equivalent of 15 ppm zirconium ions, 18.7 ppm fluoride ions and 555 ppm nitrate ions and have a pH of about 2.5. Test Solution 2 contains an equivalent of 42 ppm tannic acid; Test Solution 3 contains an equivalent of 84 ppm tannic acid while Test Solution 4 contains an equivalent of 126 ppm tannic acid.

Each of Test Solutions 1–4 is employed for treating aluminum containers in accordance with the previously described test procedure whereafter the treated containers are subjected to the pasteurization test employing the TR-4 water solution at a temperature of 165° F. for a time period of 1 hour and 2 hours, respectively. The results obtained from these tests are set forth in Table 2.

TABLE 2

| TR-4 Pasteurization Test Results | | | |
|---|---|---|---|
| Test | Tannic Acid | TR-4 Test Rating | |
| Solution | ppm | 1 Hr. at 165° F. | 2 Hrs. at 165° F. |
| 1 | 0 | 10 | 10 |
| 2 | 42 | 1 | 2 |

TABLE 2-continued

| TR-4 Pasteurization Test Results | | | |
|---|---|---|---|
| Test | Tannic Acid | TR-4 Test Rating | |
| Solution | ppm | 1 Hr. at 165° F. | 2 Hrs. at 165° F. |
| 3 | 84 | 1 | 1 |
| 4 | 126 | 1 | 1 |

It is clear from the results as set forth in Table 1 that Test Solution 1 comprising the control and devoid of any tannic acid underwent a dark gold discoloration during the pasteurization test resulting in a 10 rating. On the other hand, Test Solutions 2–4 containing varying amounts of tannic acid evidenced no or little discoloration evidencing the formation of a commercially acceptable coating.

EXAMPLE 5

Six liters of a test solution designated as no. 5 is prepared containing 12.75 ppm zirconium ions, 123.6 ppm fluoride ions, 67.5 ppm tannic acid, 124.5 ppm nitrate ions, 14.7 ppm boron ions, and 20.5 ppm of a chelating agent based on ethylenediaminetetraacetic acid sold under the brand name Versene. An identical solution of the same composition designated as Test Solution 6 is prepared to which 0.36 grams per 6 liters of $NH_4H_2PO_4$ is added to provide a phosphate ion concentration of about 50 ppm. Both Test Solution 5 and 6 have a pH of 3.78.

Cleaned aluminum cans in accordance with the aforementioned process sequence are treated in Test Solutions 5 and 6 for a period of 20 seconds at 120° F. after which they are dried. The surfaces of the treated containers are visually inspected to evaluate any noticeable color on the aluminum surface and thereafter are subjected to a muffle furnace test for a period of 5 minutes at 1000° F.

The containers treated in accordance with Test Solution 5 evidenced a very slight pale yellow appearance in the formed coating and were of a very pale yellow upon removal from the muffle furnace. In contrast, the containers treated with Test Solution 6 exhibited no discernible color in the formed coating and produced a deep gold color upon extraction from the muffle furnace. These tests evidence the advantages obtained by the addition of controlled quantities of phosphate ions in accordance with a preferred embodiment of the present invention in preventing coating discoloration when subjected to prolonged treatment times and also the formation of a discernible discoloration for quality control purposes of the deposited coating when subjected to the muffle furnace test. The 20 second treatment time employing solutions 5 and 6 at the concentrations of the constituents and the temperature employed is considered excessive in that satisfactory coatings can be formed in time periods of as little as 10 seconds.

EXAMPLE 6

An aqueous acidic test solution designated as Test Solution 7 is prepared to contain 41.6 ppm tannic acid, 100.5 ppm phosphate ions, 549 ppm nitrate ions and hafnyl fluoride is added in an amount to provide a hafnium ion concentration of 50.5 ppm and a total fluoride concentration of 32.3 ppm all of which is complexed with the hafnium constituent. Aliquot portions of test solution 7 are employed to which controlled amounts of hydrofluoric acid is added to provide test solutions 7.1 through 7.5 having free fluoride concentrations ranging from 37 to 5 ppm as set forth in the following table.

| Test Solution No. | Free-Fluoride, ppm |
|---|---|
| 7.1 | 37.0 |
| 7.2 | 27.4 |
| 7.3 | 20.0 |
| 7.4 | 12.1 |
| 7.5 | 5.0 |

Each of the aforementioned test solutions are further subdivided into aliquot portions and the pH level thereof is adjusted by the addition of controlled amounts of ammonium bicarbonate to provide operating test baths at five difference pH levels: namely, 2.1, 2.5, 3.0, 3.5 and 4.0. Each test solution at each operating pH is employed for treating the bottom of an aluminum container by spray application for a period of 20 seconds at 100° F. Thereafter, each container bottom is subjected to a TR-4 pasteurization test for a period of 30 minutes at 165° F. and the can bottoms are subsequently inspected for discoloration. The resultant TR-4 test results are tabulated in Table 3 including the average rating of the can bottoms based on two separate specimens in addition to the millivolt (mv) reading taken of each operating test solution as measured by a specific fluoride ion electrode which is indicative of the free-fluoride concentration of each bath.

TABLE 3

TR-4 PASTEURIZATION TEST RESULTS

| Test Solution No. | pH level 2.1 | 2.5 | 3.0 | 3.5 | 4.0 |
|---|---|---|---|---|---|
| Solution 7.1 | | | | | |
| Avg. Rating | 5.5 | 7 | 7 | 3 | 2 |
| mv Reading | +20 | −9 | −17 | −27 | −36 |
| Solution 7.2 | | | | | |
| Avg. Rating | 7.5 | 5 | 6.5 | 1.5 | 1 |
| mv Reading | +33 | −2 | −16 | −24 | −33 |
| Solution 7.3 | | | | | |
| Avg. Rating | 9 | 9 | 9.5 | 4 | 8 |
| mv Reading | +32 | +5 | −12 | −21 | −30 |
| Solution 7.4 | | | | | |
| Avg. Rating | 8.5 | 3.5 | 3 | 1 | 5 |
| mv reading | +31 | +2 | −13 | −20 | −27 |
| Solution 7.5 | | | | | |
| Avg. Rating | 10 | 9.5 | 10 | 2.5 | 10 |
| mv Reading | +34 | +11 | −6 | −17 | −26 |

According to the test results obtained in Table 3, all of the data under pH 3.5 provided test results within the commercially acceptable range of 1 through 4. Only test solutions 7.1 and 7.2 provided satisfactory results at a pH level of 4.0. Only test solution 7.4 provided satisfactory results at pH levels of 2.5 and 3.0. None of the test solutions are considered to provide acceptable results at the pH level of 2.1 under the specific composition and test conditions evaluated.

EXAMPLE 7

A similar test procedure as described in Example 6 is performed on a test solution designated as number 8 containing the same constituents as test solution 7 of Example 6 but wherein an equal molar quantity of zirconium ions equivalent to the hafnium ions is employed to provide a zirconium ion concentration of 25.8 ppm. In other respects, test solution 8 is identical to test solution 7. The test solution 8 similarly is adjusted to five different free-fluoride concentrations to provide test solutions 8.1 through 8.5 as set forth in the following table:

| Test Solution No. | Free-Fluoride, ppm |
|---|---|
| 8.1 | 37.0 |
| 8.2 | 27.4 |
| 8.3 | 20.0 |
| 8.4 | 12.1 |
| 8.5 | 5.0 |

Each test solution similarly is adjusted by the use of ammonium bicarbonate to five separate pH levels and is spray applied to aluminum containers under the identical conditions as set forth in Example 6. The resultant treated container bottoms are subjected to a TR-4 Pasteurization Test as in the case of Example 6 and the test results obtained are set forth in Table 4.

TABLE 4

TR-4 Pasteurization Test Results

| Test Solution No. | pH Level 2.1 | 2.5 | 3.0 | 3.5 | 4.0 |
|---|---|---|---|---|---|
| Solution 8.1 | | | | | |
| Avg. Rating | 7 | 7 | 8 | 1 | 2 |
| mv Reading | +20 | −6 | −22 | −30 | −35 |
| Solution 8.2 | | | | | |
| Avg. Rating | 5 | 6 | 8.5 | 1.5 | 3 |
| mv Reading | +25 | −3 | −14 | −20 | −31 |
| Solution 8.3 | | | | | |
| Avg. Rating | 5 | 9 | 10 | 1 | 6 |
| mv Reading | +28 | +1 | −13 | −23 | −31 |
| Solution 8.4 | | | | | |
| Avg. Rating | 6.5 | 8 | 9 | 1.5 | 8 |
| mv Reading | +35 | +5 | −7 | −18 | −29 |
| Solution 8.5 | | | | | |
| Avg. Rating | 8 | 10 | 10 | 4 | 10 |
| mv Reading | +33 | +7 | −5 | −18 | −25 |

As noted in Table 4, all of operating test solutions 8.1 through 8.5 produced can bottoms having acceptable TR-4 results at a pH level of 3.5. Only operating test solutions 8.1 and 8.2 had satisfactory TR-4 test results at a pH level of 4.0. None of the operating test solutions produced acceptable TR-4 test results at pH levels of 2.1, 2.5 and 3.0.

The test results contained in Tables 3 and 4 are indicative of the free-fluoride concentration in relationship to a constant phosphate ion concentration of about 100 ppm in the operating baths at varying pH and the resultant effect on discoloration during a TR-4 Pasteurization Test. It will be appreciated, that variations in the specific constituents comprising the operating test baths and the temperature and duration of treatment will cause variations in the specific results obtained. The Millivolt Reading of each of the test operating baths is also indicative of the desirable control range as a measure of free-fluoride concentration for a specific bath to obtain consistent satisfactory results.

EXAMPLE 8

A control solution is prepared in accordance with an embodiment of the present invention devoid of any phosphate ions containing 0.125 g/l nitrate ions, 0.015 g/l boron, 0.02 g/l Versene sequestrant, 0.04 g/l ammonia ions, 0.068 g/l tannic acid and sufficient potassium zirconium fluoride salt and hydrofluoric acid to provide a zirconium ion concentration of 0.013 g/l, potassium ions of 0.01 g/l and 0.124 g/l fluoride ions. The pH of the control test solution 9 is adjusted with ammonium bicarbonate to a nominal pH ranging from 3.7 to 3.8 and averaging 3.75. Control test solution 9 is spray applied for a period of 20 seconds at 100° F. to aluminum containers and thereafter is subjected to a TR-4 Pasteurization Test for a period of 30 minutes at a temperature of 155° F. to evaluate bare corrosion resistance and discoloration. The TR-4 test results reveal a colorless coating after the TR-4 test having a rating of 1. However, the control test solution 9 is susceptible to forming a light yellow color on the aluminum container as a result of excessive treating times and also does not provide a deep, distinct color on the container during the muffle furnace test. As previously indicated, the addition of controlled amounts of phosphate ions inhibits coating discoloration in spite of excessive treatment times and also provides a deep distinct gold color during the muffle furnace test. At the same time, however, the addition of such phosphate ions detracts from the TR-4 Pasteurization Test results causing discoloration in many instances.

In order to evaluate the effect of two different levels of phosphate ion concentrations in control solution 9 and the effect of the addition of supplemental zirconium and/or fluoride ions to the bath, test solutions 9.1 through 9.5 are prepared. Test solution 9.1 is identical to test solution 9 but further contains the addition of 25 ppm and 100 ppm phosphate ions. Test solution 9.2 is identical to test solution 9.1 but further contains 0.12 g/l of potassium zirconium fluoride. Test solution 9.3 is identical to test solution 9.1 but further contains 0.18 g/l of zirconium nitrate pentahydrate to provide a zirconium ion concentration identical to that in test solution 9.2. Test solution 9.4 is identical to test solution 9.3 but further contains 0.05 g/l hydrofluoric acid to provide additional free-fluoride concentration in an amount equal to the additional fluoride ions added to test solution 9.2. Finally, test solution 9.5 is identical to test solution 9.1 but further containing 0.05 g/l of 100% hydrofluoric acid equivalent to that added to test solution 9.4.

Each of test solutions 9.1 through 9.5 is employed for treating the bottoms of aluminum containers by spray application for a period of 20 seconds at a temperature of 100° F. The treated container bottoms are thereafter subjected to a TR-4 Pasteurization Test for a period of 30 minutes at 155° F. in a manner identical to that employed on the container bottoms treated with control test solution 9. The TR-4 test results and the Millivolt readings of the test solutions as indicative of free-fluoride ion concentration are set forth in Table 5.

TABLE 5

| TR-4 PASTEURIZATION TEST RESULTS | | |
|---|---|---|
| Test Solution No. | | |
| Solution 9 | | |
| Avg. Rating | 1 | |
| mv Reading | −8 | |
| | Phosphate ion concentration, ppm | |
| | 25 ppm | 100 ppm |
| Solution 9.1 | | |
| Avg. Rating | 8.5 | 8 |
| mv Reading | −7 | −11 |
| Solution 9.2 | | |
| Avg. Rating | 3 | 6.5 |
| mv Reading −16 | −25 | |
| Solution 9.3 | | |

TABLE 5-continued

| TR-4 PASTEURIZATION TEST RESULTS | | |
|---|---|---|
| Test Solution No. | | |
| Avg. Rating | 10 | 10 |
| mv Reading | +14 | −14 |
| Solution 9.4 | | |
| Avg. Rating | 3.5 | 5.5 |
| mv Reading | +1 | −9 |
| Solution 9.5 | | |
| Avg. Rating | 2 | 4.5 |
| mv Reading | −40 | −35 |

It is clear from the results of Table 5 that the addition of 25 and 100 ppm phosphate ions to control test solution 9 as evidenced by the ratings obtained on test solution 9.1 results in an unacceptable discoloration of the container bottoms producing ratings of about 8. The addition of additional zirconium and fluoride ions to such solution as evidenced by the results obtained on test solution 9.2 effects an improvement in the TR-4 results at the 25 ppm phosphate ion level but remains unacceptable at an average rating of 6.5 at the 100 ppm phosphate ion concentration level. The addition of an equivalent amount of zirconium ions as evidenced by the results obtained on test solution 9.3 to the additional zirconium ions added to test solution 9.2 produces TR-4 test results which are entirely unacceptable at average ratings of 10. On the other hand, the further addition of free-fluoride in combination with zirconium nitrate as represented by test solution 9.4 produces a distinct improvement providing an average rating of 3.5 at the 25 ppm phosphate ion level and a rating of 5.5 at the 100 ppm phosphate ion level. By the addition of only free-fluoride as evidenced by test solution 9.5, very acceptable TR-4 results are obtained at an average rating of 2 at the 25 ppm phosphate ion concentration level while a rating of 4.5 is obtained at the higher phosphate ion concentration.

These data clearly substantiate the necessity of providing a controlled free-fluoride concentration in treating baths also containing phosphate ions to counteract the discoloration effect of such phosphate ions during a TR-4 Pasteurization Test of the treated aluminum surface. A Millivolt reading of −40 of the specific bath composition represented by test solution 9.5 provides a control for achieving coatings which will satisfactorily pass a TR-4 Pasteurization Test in terms of free-fluoride concentration. This Millivolt reading compares to a Millivolt reading of −8 on control test solution 9 devoid of any phosphate ions and which contains fluoride ions which for the most part are complexed with the zirconium ions and boron ions present in the bath.

EXAMPLE 9

The interrelationship of tannic acid concentration and treatment times to achieve coatings having a satisfactory TR-4 test performance is demonstrated by the test solutions of this example. A control test solution designated as 10 is prepared containing 25 ppm zirconium ions, 138.9 ppm fluoride ions, 25 ppm phosphate ions, 124.5 ppm nitrate ions, 14.7 ppm boron and 19.5 ppm Versene (a chelating agent based on ethylenediaminetetraacetic acid). The pH of the bath is adjusted to a value of 3.7. A series of test solutions based on control solution 10 is prepared incorporating varying amounts of tannic acid. Test solution 10.1 contains 17 ppm tannic acid, test solution 10.2 contains 33 ppm tanic acid, test solution 10.3 contains 50 ppm tannic acid and test solution 10.4 contains 66 ppm tannic acid.

Each of test solutions 10 through 10.4 is employed for treating aluminum cans by spray application at a solution temperature of 115° F. at alternate processing times of 10 and 20 seconds, respectively. Following each treatment, the coated cans are cold water rinsed for a period of 15 seconds followed by a 5 second deionized water rinse and are oven dried at 380° F. for a period of 5 minutes. Each of the treated aluminum cans are subjected to a TR-4 test procedure for a period of 30 minutes at 165° F. The test results obtained are set forth in Table 6.

TABLE 6

TR-4 PASTEURIZATION TEST RESULTS

| Test Solution | Tannin Conc., ppm | Tr-4 Rating 10 Seconds | Tr-4 Rating 20 Seconds |
|---|---|---|---|
| 10 | 0 | 9 | 8 |
| 10.1 | 17 | 5 | 1 |
| 10.2 | 33 | 1 | 1 |
| 10.3 | 50 | 1 | 1 |
| 10.4 | 66 | 1 | 1 |

It is evident from the data presented in Table 6 that test solution 10 devoid of any tannic acid produced unacceptable ratings due to the severe discoloration incurred at treating periods of both 10 seconds and 20 seconds. At a tannic acid concentration of only 17 ppm as represented by test solution 10.1, no discoloration of the coating was observed at the conclusion of the TR-4 test at a treating time of 20 seconds whereas an unacceptable rating of 5 was obtained for this same solution at a treatment time of only 10 seconds. At the higher tannin concentrations as represented by test solutions 10.2, 10.3 and 10.4, no discoloration occurred during the Tr-4 test. The foregoing data clearly substantiate the effectiveness of the tannin constituent in an operating bath and the fact that very low concentrations thereof do provide a significant improvement but require substantially longer treating times in order to achieve a coating resistant to discoloration on TR-4 testing equivalent to that obtained at higher tannin concentrations.

The operating bath is conveniently prepared employing a make-up concentrate containing the several constituents in appropriate amounts which can be diluted with water to the final desired operating concentration. The broad useable as well as preferred concentrations of a bath make-up concentrate is set forth in Table 7.

TABLE 7

BATH MAKE-UP CONCENTRATE

| Constituent | Percent by Weight Broad | Percent by Weight Preferred |
|---|---|---|
| Zr and/or Hf | 0.01–2.0 | 0.15–0.25 |
| $F^-$ | 0.0355–7.1 | 0.5–0.9 |
| $NO_3^{-=}$ | 0.025–5.0 | 0.35–0.65 |
| $PO_4$ | 0.009–1.8 | 0.13–0.23 |
| Boron | 0.00295–.59 | 0.04–0.08 |
| EDTA | 0.0039–.78 | 0.06–0.1 |
| Tannic Acid | 0.0135–2.7 | 0.2–0.35 |
| $NH_3$ | 0.0125–2.5 | 0.2–0.3 |

The make-up concentrate is usually in concentration so as to provide a dilution thereof employing one part concentrate and 39 parts water to form an operating bath containing 2½% of the concentrate. The zirconium and hafnium ions are preferably introduced in the form of potassium zirconium fluoride and hafnyl fluoride, respectively which concurrently supplies some of the fluoride ions in the bath. The remaining fluoride concentration is preferably introduced in the form of hydrofluoric acid and a 49% aqueous solution of fluoboric acid ($HBF_4$). The phosphate ions are preferably introduced in the form of monoammonium phosphate and the ammonium ions as indicated in Table 7 are usually present as a result of the use of ammonium hydroxide for pH adjustment. The tannic acid constituent can be introduced as such or as tannin extracts employing a quantity to provide a weight equivalent basis equal to that of tannic acid. The EDTA or equivalent complexing or sequestering agent is advantageously employed and will vary in amount depending upon the hardness of the tap water employed in formulating the operating bath. The sequesterant is effective to complex hard water salts including calcium, magnesium, iron, etc. ions present in the make-up water.

A particularly satisfactory make-up concentrate for dilution to a final concentration of 2.5% contains 0.2% zirconium ions, 0.71% total fluoride ions, 0.5% nitrate ions, 0.18% phosphate ions, 588 ppm boron, 0.078% EDTA (Versene) 0.27% tannic acid and 0.25% ammonia. Such concentrate when diluted with deionized water exhibits a pH of about 3.1. Upon dilution, the zirconium ion concentration in the operating bath is about 50 ppm.

Similarly, concentrates containing the bath constituents to effect a replenishment thereof during use can satisfactorily be prepared which are added directly to the operating bath without prior dilution.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An acidic aqueous chromium-free composition of pH value less than 5 containing in dissolved form hafnium, fluoride and a vegetable tannin in amounts, at least 1 ppm of each, sufficient, when contacted with a metal surface, to impart corrosion resistance to the metal surface.

2. The composition of claim 1 wherein the hafnium concentration is from 4 to 110 ppm.

3. The composition of claim 1 wherein the fluoride is present in a weight ratio of F:Hf of at least 0.64:1.

4. The composition of claim 1 additionally containing nitric acid or a nitrate compound.

5. The composition of claim 1 additionally containing a phosphate compound.

6. The composition of claim 5 wherein the phosphate concentration is at least 10 ppm.

7. The composition of claim 1 wherein the tannin concentration is at least 25 ppm.

8. The composition of claim 1 additionally containing citric acid or a citrate compound.

9. The composition of claim 1 additionally containing a zirconium compound.

10. The composition of claim 9 wherein the hafnium concentration exceeds the zirconium concentration.

11. The composition of claim 1 additionally containing a titanium compound.

12. The composition of claim 11 wherein the hafnium concentration exceeds the titanium concentration.

13. The composition of claim 1 additionally containing a lithium compound.

14. The composition of claim 1 additionally containing a resin compound.

15. The composition of claim 1 additionally containing at least one acid or alkaline pH adjusting compound.

16. A chromium-free process for forming a corrosion resistant paint receptive coating on a metal surface comprising contacting the surface with an aqueous acidic composition of pH value less than 5 containing at least 1 ppm of both dissolved hafnium and fluoride for a time and at a temperature sufficient to produce a coating thereon.

17. The process of claim 16 wherein the pH value is less than 3.5.

18. The process of claim 16 wherein the pH value is not less than 2.

19. The process of claim 16 wherein the hafnium concentration is from 4 to 100 ppm.

20. The process of claim 16 wherein the fluoride is present in a weight ratio of F:Hf of at least 0.64:1.

21. The process of claim 16 additionally containing a phosphate compound.

22. The process of claim 16 wherein the composition additionally contains a vegetable tannin compound.

23. The process of claim 16 wherein the tannin concentration is at least 1 ppm.

24. The process of claim 16 wherein the composition additionally contains dissolved zirconium.

25. The process of claim 16 wherein the composition additionally contains dissolved titanium.

26. The process of claim 16 wherein the metal surface treated is selected from the group consisting of ferrous, zinc and aluminum.

27. The process of claim 16 wherein the time of contact is from 0.1 seconds to 10 minutes.

28. The process of claim 27 wherein the time of contact is from about 2 seconds to 1 minute.

29. The process of claim 16 wherein the temperature of the solution is at least 70° F. and less than the boiling point of the solution.

30. The process of claim 29 wherein the temperature is between about 100° and 160° F.

31. A process for imparting corrosion resistance to metal surface comprising contacting the surface with the composition of claim 1 and thereafter applying a paint to the surface.

32. An acidic aqueous chromium-free composition of pH value less than 5 containing in dissolved form phosphate ions in an amount of about 10 up to about 200 ppm and zirconium, fluroide and a vegetable tannin in amounts, at least 1 ppm of each, sufficient, when contacted with a metal surface, to impart corrosion resistance to the metal surface.

33. The composition of claim 32 in which said zirconium is present in an amount of about 4 to about 100 ppm.

34. The composition of claim 32 in which said fluoride is present in a weight ratio of F:Zr of at least 1.25:1.

35. The composition of claim 34 in which said zirconium is present in an amount of about 4 to about 100 ppm.

36. The composition of claim 34 in which said tannin is present in an amount of at least 25 ppm calculated as a weight equivalent to tannic acid.

37. The composition of claim 34 in which said tannin is present in an amount up to about 500 ppm calculated as a weight equivalent to tannic acid.

38. The composition of claim 34 in which said phosphate ions are present in an amount of about 25 to about 75 ppm.

39. The composition of claim 34 in which said phosphate ions are present in an amount of about 45 to about 55 ppm.

40. The composition of claim 34 containing about 50 ppm zirconium, about 180 ppm total fluoride, about 70 ppm tannin calculated on a weight equivalent to tannic acid, about 50 ppm phosphate ions, said composition of a pH value of about 3 to about 4.5.

41. The composition of claim 34 additionally containing nitrate ions.

42. The composition of claim 34 additionally containing a titanium compound.

43. The composition of claim 34 additionally containing a lithium compound.

44. The composition of claim 34 additionally containing a boron compound.

45. The composition of claim 44 in which said boron compound comprises fluorboric acid.

46. The composition of claim 34 additionally containing a sequestering agent present in an amount sufficient to complex at least a portion of the hard water salts including calcium, magnesium and iron.

47. The composition of claim 46 in which said sequestering agent comprises EDTA.

48. The composition of claim 34 additionally containing phosphate ions in an amount of about 10 to about 200 ppm and fluoride ions in an amount to provide a controlled free-fluoride concentration.

49. A process for forming a corrosion resistant coating on a metal surface which comprises the steps of contacting the surface with an aqueous acidic composition as defined in any one of claims 35 through 37 and 38 through 48 at a temperature and for a period of time sufficient to produce the desired coating thereon.

50. The composition of claim 32 in which said tannin is present in an amount of at least 25 ppm calculated as a weight equivalent to tannic acid.

51. The composition of claim 32 in which said tannin is present in an amount up to about 500 ppm calculated as a weight equivalent to tannic acid.

52. The composition of claim 32 in which said phosphate ions are present in an amount of about 25 to about 75 ppm.

53. The composition of claim 32 in which said phosphate ions are present in an amount of about 45 to about 55 ppm.

54. The composition of claim 32 containing about 50 ppm zirconium, about 180 ppm total fluoride, about 70 ppm tannin calculated on a weight equivalent to tannic acid, about 50 ppm phosphate ions, said composition of a pH value of about 3 to about 4.5.

55. The composition of claim 32 additionally containing nitrate ions.

56. The composition of claim 32 additionally containing a titanium compound.

57. The composition of claim 32 additionally containing a lithium compound.

58. The composition of claim 32 additionally containing a boron compound.

59. The composition of claim 58 in which said boron compound comprises fluoboric acid.

60. The composition of claim 32 additionally containing a sequestering agent present in an amount sufficient to complex at least a portion of the hard water salts including calcium, magnesium and iron.

61. The composition of claim 60 in which said sequestering agent comprises EDTA.

62. The composition of claim 32 additionally containing phosphate ions in an amount of about 10 to about 200 ppm and fluoride ions in an amount to provide a controlled free-fluoride concentration.

63. A process for forming a corrosion resistant coating on a metal surface which comprises the steps of contacting the surface with an aqueous acidic composition as defined in claim 32 or 33 or 34 or 50 or 51 or 52 or 53 or 54 or 55 or 56 or 57 or 58 or 59 or 60 or 61 or 62 at a temperature and for a period of time sufficient to produce the desired coating thereon.

64. An acidic aqueous chromium-free composition of pH value of about 3 to about 4.5 containing in dissolved form zirconium, fluoride and a vegetable tannin amounts, at least 1 ppm of each, sufficient, when contacted with a metal surface, to impart corrosion resistance to the metal surface.

65. The composition of claim 64 in which said zirconium is present in an amount of about 4 to about 100 ppm.

66. The composition of claim 64 in which said fluoride is present in a weight ratio of F:Zr of at least 1.25:1.

67. The composition of claim 64 in which said tannin is present in an amount of at least 25 ppm calculated as a weight equivalent to tannic acid.

68. The composition of claim 64 in which said tannin is present in an amount up to about 500 ppm calculated as a weight equivalent to tannic acid.

69. The composition of claim 64 additionally containing phosphate ions in an amount of about 10 to about 200 ppm.

70. The composition of claim 69 in which said phosphate ions are present in an amount of about 25 to about 75 ppm.

71. The composition of claim 69 in which said phosphate ions are present in an amount of about 45 to about 55 ppm.

72. The composition of claim 69 containing about 50 ppm zirconium, about 180 ppm total fluoride, about 70 ppm tannin calculated on a weight equivalent to tannic acid, about 50 ppm phosphate ions, said composition of a pH value of about 3 to about 4.5.

73. The composition of claim 64 additionally containing nitrate ions.

74. The composition of claim 64 additionally containing a titanium compound.

75. The composition of claim 64 additionally containing a lithium compound.

76. The composition of claim 64 additionally containing a boron compound.

77. The composition of claim 76 in which said boron compound comprises fluoboric acid.

78. The composition of claim 64 additionally containing a sequestering agent present in an amount sufficient to complex at least a portion of the hard water salts including calcium, magnesium and iron.

79. The composition of claim 78 in which said sequestering agent comprises EDTA.

80. The composition of claim 64 additionally containing phosphate ions in an amount of about 10 to about 200 ppm and fluoride ions in an amount to provide a controlled free-fluoride concentration.

81. A process for forming a corrosion resistant coating on a metal surface which comprises the steps of contacting the surface with an aqueous acidic composition as defined in any one of claims 64 through 80 at a temperature and for a period of time sufficient to produce the desired coating thereon.

* * * * *